US006401748B1

(12) United States Patent
Wang

(10) Patent No.: US 6,401,748 B1
(45) Date of Patent: Jun. 11, 2002

(54) LAVATORY FAUCET PROVIDED WITH MEANS TO LOCATE WATER MIXING BOLT THEREOF

(76) Inventor: Shih-Ming Wang, P.O. Box 453, Taichung (TW)

( * ) Notice: Subject to any disclaimer, the term of this patent is extended or adjusted under 35 U.S.C. 154(b) by 0 days.

(21) Appl. No.: 09/877,091

(22) Filed: Jun. 11, 2001

(51) Int. Cl.[7] ..... E03C 1/04
(52) U.S. Cl. ..... 137/359; 137/801
(58) Field of Search ..... 137/359, 801; 4/678

(56) References Cited

U.S. PATENT DOCUMENTS 5,014,749 A * 5/1991 Humpert et al. ..... 137/801
5,232,008 A * 8/1993 Jeffress et al. ..... 137/15
5,558,128 A * 9/1996 Pawelzik et al. ..... 137/801
6,220,279 B1 * 4/2001 Segien ..... 137/359

* cited by examiner

*Primary Examiner*—A. Michael Chambers

(57) ABSTRACT

A lavatory faucet comprises a connection pipe, a fixation board, a water mixing bolt tube, a locating bolt, and a faucet neck for discharging water. The water mixing bolt tube is located securely by the connection pipe and the fixation board, which are disposed between a cold water control valve and a hot water control valve. The faucet neck is securely connected with the water mixing bolt tube in conjunction with the locating bolt which is engaged with a threaded hole of the bottom end of the faucet neck via a through hole of a lug of the connection pipe.

1 Claim, 4 Drawing Sheets

LAVATORY FAUCET PROVIDED WITH MEANS TO LOCATE WATER MIXING BOLT THEREOF

BACKGROUND OF THE INVENTION

1. Field of the Invention

The present invention relates generally to a lavatory faucet, and more particularly to a locating structure of the water mixing bolt of the lavatory faucet.

2. Description of Related Art

As shown in FIG. 1, a prior art lavatory faucet 20 is located on a lavatory basin 16 such that the lavatory faucet 20 is fastened with the lug 22 of a connection pipe 13 by two fastening bolts 21. The connection pipe 13 is located between a cold water valve 10 and a hot water valve 11, which are respectively connected with a cold water pipe 14 and a hot water pipe 15. The cold water pipe 14 and the hot water pipe 15 are received respectively in a mounting hole 17 of the lavatory basin 16 in conjunction with a locating board 18 and a locating ring 19. Located between the lavatory basin 16 and the lavatory faucet 20 is a cover board 23. The prior art lavatory faucet 20 described above is defective in design in that both locating board 18 and the locking rings 19 are located at the underside of the lavatory basin 16 and are therefore difficult to be reached by hand or hand tool. As a result, the locking rings 19 can not be easily unfastened to disassemble the water valves 10 and 11, as well as the lavatory faucet 20. In other words, the work of replacing the lavatory faucet 20 is time-consuming at best.

BRIEF SUMMARY OF THE INVENTION

The primary objective of the present invention is to provide a lavatory faucet which is free from the deficiency of the prior art lavatory faucet described above.

The objective of the present invention is attained by a lavatory faucet comprising a connection pipe, a fixation board, a water mixing bolt tube, a locating bolt, and a faucet neck. The water mixing bolt tube is located securely by the connection pipe and the fixation board, which e disposed between two water control valves. The faucet neck is secured to the water mixing bolt tube in conjunction with the locating bolt which is engaged with a threaded hole of the faucet neck via a through hole of a lug of the connection pipe.

The features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
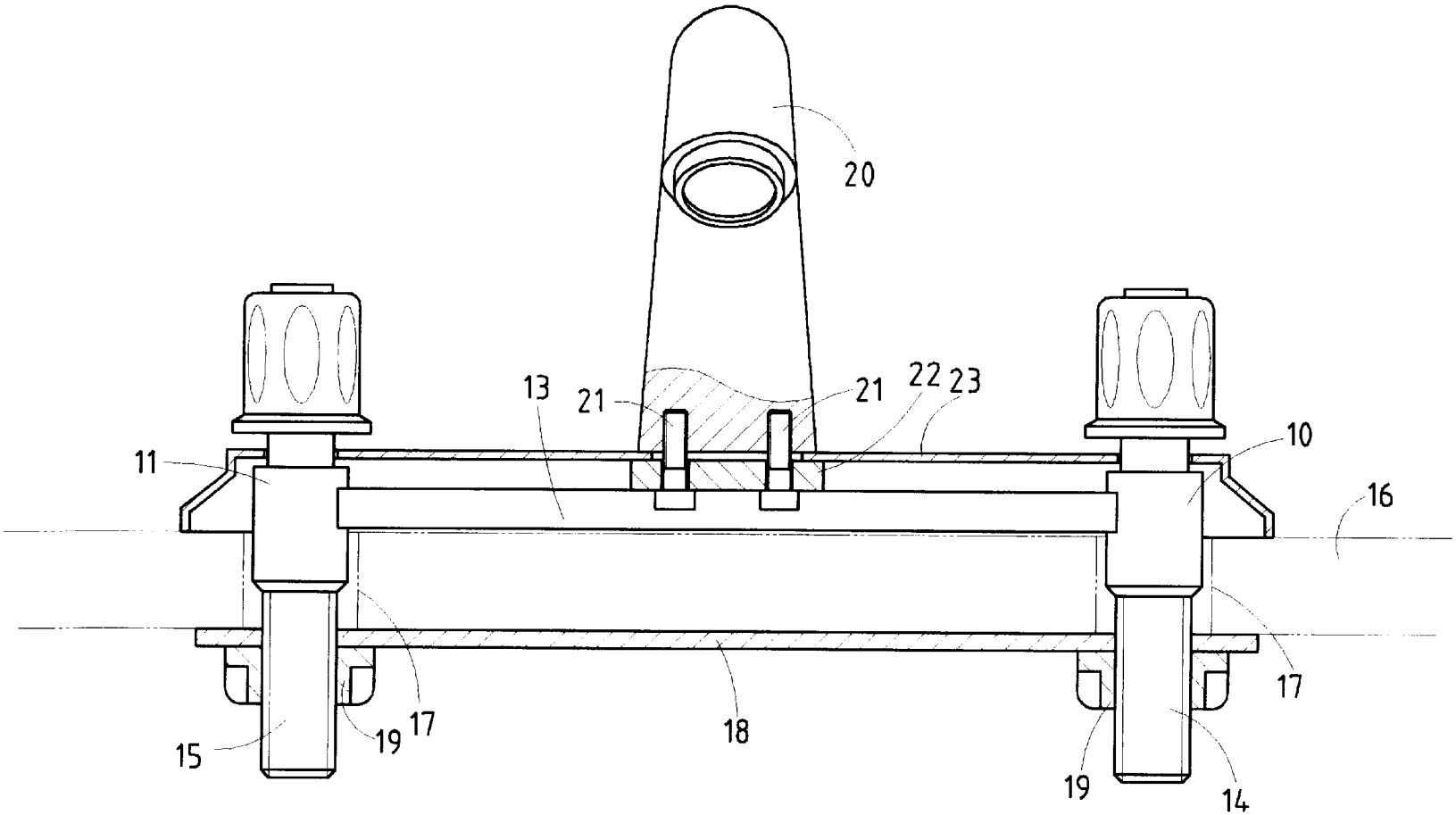
FIG. 1 PRIOR ART
FIG. 1 shows a sectional schematic view of a prior art lavatory faucet which is mounted on a lavatory basin.
Figure 2:
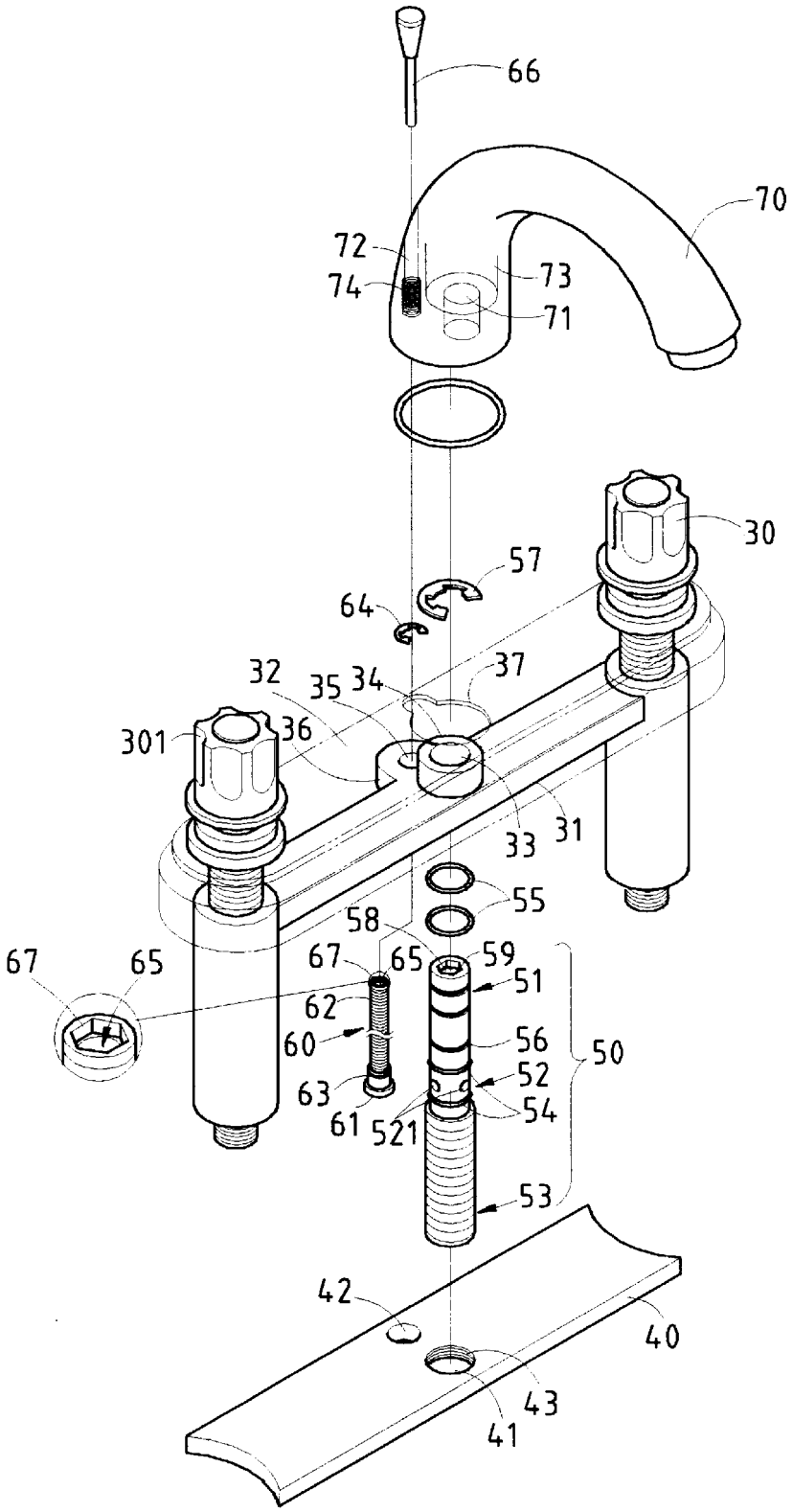
FIG. 2 shows an exploded view of a lavatory faucet of the preferred embodiment of the present invention.
Figure 3:
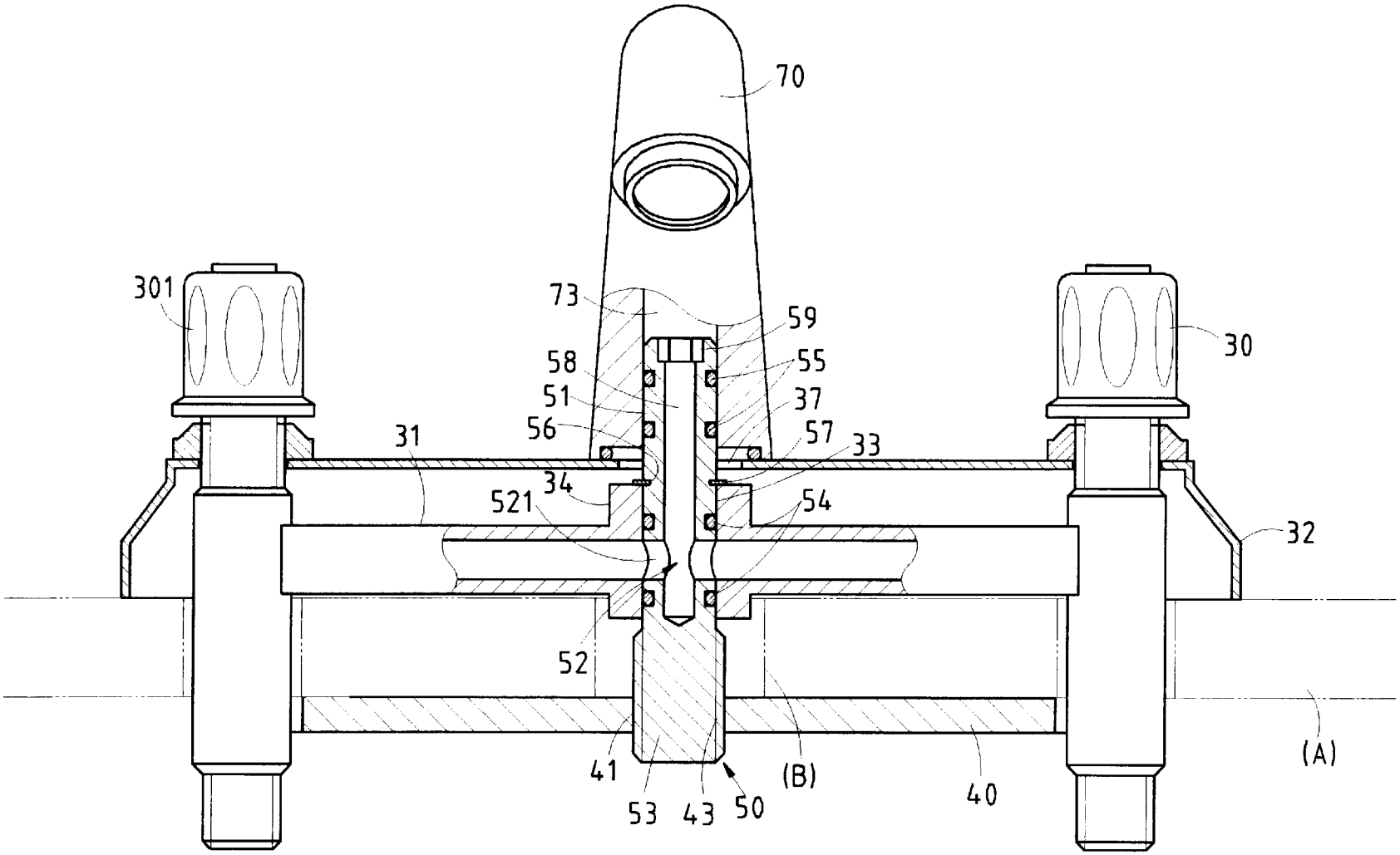
FIG. 3 shows a sectional schematic view of the lavatory faucet of the present invention which is mounted on a lavatory basin.
Figure 4:
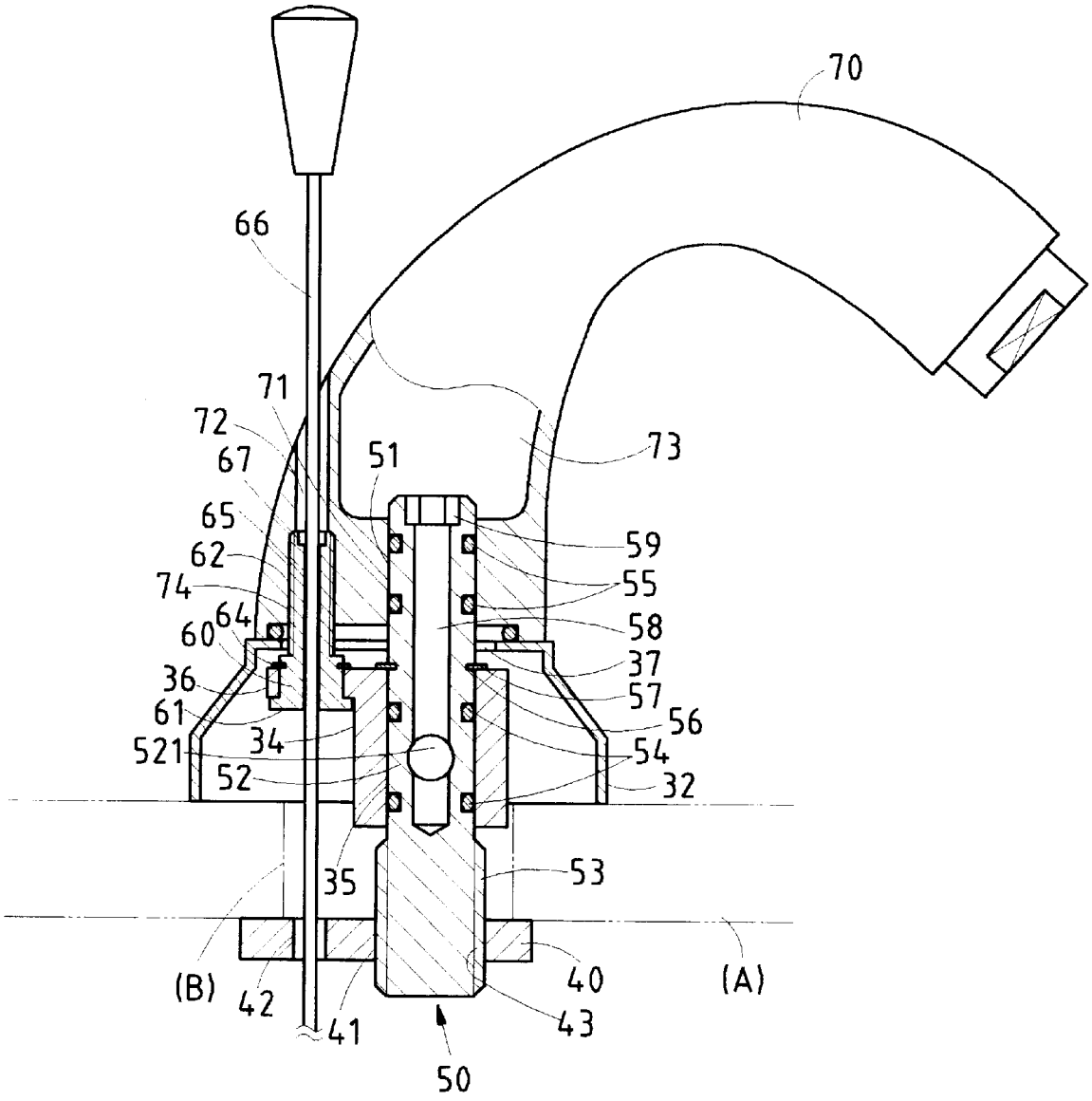
FIG. 4 shows another sectional schematic view of the preferred embodiment of the present invention.

As shown in FIGS. 2–4, a lavatory faucet embodied in the present invention is formed of a connection pipe 31, a fixation board 40, a water mixing bolt tube 50, a locating bolt 60, and a faucet neck 70.

The connection pipe 31 is fastened between a cold water control valve 30 and a hot water control valve 301 such that the connection pipe 31 is located on the upper surface of a lavatory basin "A". The connection pipe 31 and the water control valves 30 and 301 are made integrally. The connection pipe 31 is covered by a cover body 32. The connection pipe 31 is provided at the center with a bolt tube seat 34 having a seat hole 33 in communication with the connection pipe 31 and the water control valves 30 an 301. The connection pipe 31 is further provided at the center with a lug 36 having a through hole 35 and corresponding in location to the bolt tube seat 34. The cover body 32 is provided with a through hole 37.

The fixation board 40 is disposed between the two water control valves 30 and 301 and under the connection pipe 31. The fixation board 40 is provided with a first through hole 41 and a second through hole 42. The first through hole 41 has inner threads 43 and is in alignment with the seat hole 33 of the bolt tube seat 34 of the connection pipe 31.

The water mixing bolt tube 50 is provided in the outer wall with a connection portion 51, a water entering portion 52 having a water hole 521, and an outer threaded portion 53. The water mixing bolt tube 50 is received in a mounting hole "B" of the lavatory basin "A" such that the outer threaded portion 53 is engaged with the inner threads 43 of the first through hole 41 of the fixation board 40, and that the water hole 521 of the water mixing bolt tube 50 is in communication with the connection pipe 31. The water mixing bolt tube 50 is provided with a plurality of washers 54 and 55, as well as a retaining groove 56 for locating a retaining ring 57. The water mixing bolt tube 50 is provided in the top end with a fitting slot 59 engageable with a hand tool by means of which the water mixing bolt tube 50 is turned. The retaining ring 57 prevents the water mixing bolt tube 50 from sliding downwards.

The locating bolt 60 has a head 61, a threaded shank 62, a retaining groove 63, and a fitting slot 67 which is opposite in location to the head 61 and is engageable with a hand tool for turning the locating bolt 60. The locating bolt 60 is provided with a longitudinal through hole 65. The fitting slot 67 is located in one end of the longitudinal through hole 65. The locating bolt 60 is received in the through hole 35 of the lug 36 of the connection pipe 31 in conjunction with a retaining ring 64. A lift rod 66 is put through the longitudinal through hole 65.

The faucet neck 70 is provided in the bottom end with a connection slot 71, and a locating hole 72 having inner threads 74. The faucet neck 70 is further provided with a water discharging duct 73 in communication with the connection slot 71 in which the connection portion 51 of the water mixing bolt tube 50 is received. The faucet neck 70 is located by the locating bolt 60 such that the inner threads 74 of the locating hole 72 are engaged with the threaded shank 62 of the locating bolt 60.

As the water mixing bolt tube 50 is turned by the hand tool which is engaged with the fitting slot 59, the fixation board 40 is raised to press against the lavatory basin "A", thereby locating securely the water mixing bolt tube 50. Similarly, the locating bolt 60 can be turned by a hand tool which is engaged with the fitting slot 67 of the locating bolt 60, thereby causing the faucet neck 70 to move downwards to press against the cover body 32. The faucet neck 70 can be easily replaced by turning the locating bolt 60 in reverse.

The embodiment of the present invention described above is to be regarded in all respects as being merely illustrative and not restrictive. Accordingly, The present invention may be embodied in other specific forms without deviating from the spirit thereof. The present invention is therefore to be limited only by the scope of the following claim.

I claim:

1. A lavatory faucet comprising:

a connection pipe fastened between a cold water control valve and a hot water control valve such that said connection pipe is located on the water surface of a lavatory basin, and that said connection pipe is covered by a cover body, said connection pipe being provided with a bolt tube seat having a seat hole, said connection pipe being made integrally with the cold water control valve and the hot water control valve each that said seat hole is in communication with the cold water control valve and the hot water valve, said connection pipe being further provided in an outer wall with a lug extending therefrom and having a through hole;

a fixation board disposed between the cold water control valve and the hot water control valve and under said connection pipe, said fixation board provided with a first through hole and a second through hole, said first through hole having inner threads and being in alignment with said seat hole of said connection pipe;

a water mixing bolt tube provided in an outer wall with a connection portion, a water entering portion having a water hole, and an outer threaded portion, said water mixing bolt tube being received in a mounting hole of the lavatory basin such that said outer threaded portion of said water mixing bolt tube is engaged with said first through hole of said fixation board, and that said water hole of said water mixing bolt tube is in communication with said connection pipe, said water mixing bolt tube provided in a top end with a fitting slot engageable with a hand tool;

a locating bolt having a threaded shank, a head, a longitudinal through hole, and a fitting slot which is located in one end of said longitudinal through hole and is opposite in location to said head, said locating bolt being rotatable by a hand tool which is engaged with said fitting slot of said locating bolt; and a faucet neck provided in an interior with a water discharging duct, in a bottom end with a connection slot in communication with said water discharging duct, said faucet neck further provided in the bottom end with a threaded hole, said faucet neck being connected with said water mixing bolt tube such that said connection portion of said water mixing bolt tube is received in said connection slot of said faucet neck, said faucet neck being located by said locating bolt such that said threaded hole of the bottom end of said faucet neck is engaged with said threaded shank of said locating bolt which is put through said through hole of said lug of said connection pipe.

* * * * *